US010502055B2

(12) United States Patent
Corre et al.

(10) Patent No.: US 10,502,055 B2
(45) Date of Patent: Dec. 10, 2019

(54) SYSTEMS AND METHODS FOR AN EXPANDABLE PACKER

(71) Applicant: Schlumberger Technology Corporation, Sugar Land, TX (US)

(72) Inventors: Pierre-Yves Corre, Abbeville (FR); Lambert Rouchon, Abbeville (FR); Stéphane Metayer, Abbeville (FR); Julien Lassalle, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 383 days.

(21) Appl. No.: 15/371,628

(22) Filed: Dec. 7, 2016

(65) Prior Publication Data

US 2017/0159400 A1 Jun. 8, 2017

(30) Foreign Application Priority Data

Dec. 7, 2015 (EP) ..... 15290302

(51) Int. Cl.
*E21B 33/127* (2006.01)
*E21B 49/10* (2006.01)

(52) U.S. Cl.
CPC ..... *E21B 49/10* (2013.01); *E21B 33/127* (2013.01)

(58) Field of Classification Search
CPC ..... E21B 33/127; E21B 33/1208
See application file for complete search history.

(56) References Cited

U.S. PATENT DOCUMENTS

| | | | | |
|---|---|---|---|---|
| 3,424,246 | A * | 1/1969 | Myers | E21B 23/06 166/127 |
| 3,524,503 | A * | 8/1970 | Baker | E21B 33/127 166/187 |
| 4,897,139 | A * | 1/1990 | Wood | E21B 33/1277 156/188 |
| 9,447,653 | B1 * | 9/2016 | Abi Aad | E21B 33/1277 |
| 2003/0196795 | A1 * | 10/2003 | Kutac | E21B 33/127 166/187 |
| 2007/0107913 | A1 * | 5/2007 | Arnold | E21B 23/01 166/387 |
| 2012/0227969 | A1 * | 9/2012 | Gray | E21B 21/103 166/285 |

* cited by examiner

*Primary Examiner* — Shane Bomar
(74) *Attorney, Agent, or Firm* — Trevor G. Grove

(57) ABSTRACT

The present disclosure relates to a downhole packer assembly that includes an outer skin, an inner packer disposed within the outer skin such that inflation of the inner packer is configured to expand the outer skin, a pair of mechanical fittings engaged with axial ends of the outer skin, and a ring assembly disposed within at least one of the pair of mechanical fittings. The ring assembly includes a shear pin configured to shear upon application of a tensile force to the downhole packer assembly.

15 Claims, 8 Drawing Sheets

SYSTEMS AND METHODS FOR AN EXPANDABLE PACKER

CROSS REFERENCE TO RELATED APPLICATIONS

This application claims the benefit of European Patent Application No. 15290302.7 filed on Dec. 7, 2015, incorporated by reference herein in its entirety.

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a downhole packer assembly that includes an outer skin, an inner packer disposed within the outer skin such that inflation of the inner packer is configured to expand the outer skin, a pair of mechanical fittings engaged with axial ends of the outer skin, and a ring assembly disposed within at least one of the pair of mechanical fittings. The ring assembly includes a shear pin configured to shear upon application of a tensile force to the downhole packer assembly.

The present disclosure also relates to a method that includes providing a packer assembly having an inner packer disposed within an outer skin, a pair of mechanical fittings engaged with axial ends of the outer skin, and a ring assembly disposed within at least one of the pair of mechanical fittings. The ring assembly includes a shear pin. The method also includes positioning the packer assembly in a wellbore, inflating the inner packer until the outer skin seals against a wall of the wellbore, applying a tensile force to the packer assembly, and shearing the shear pin.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
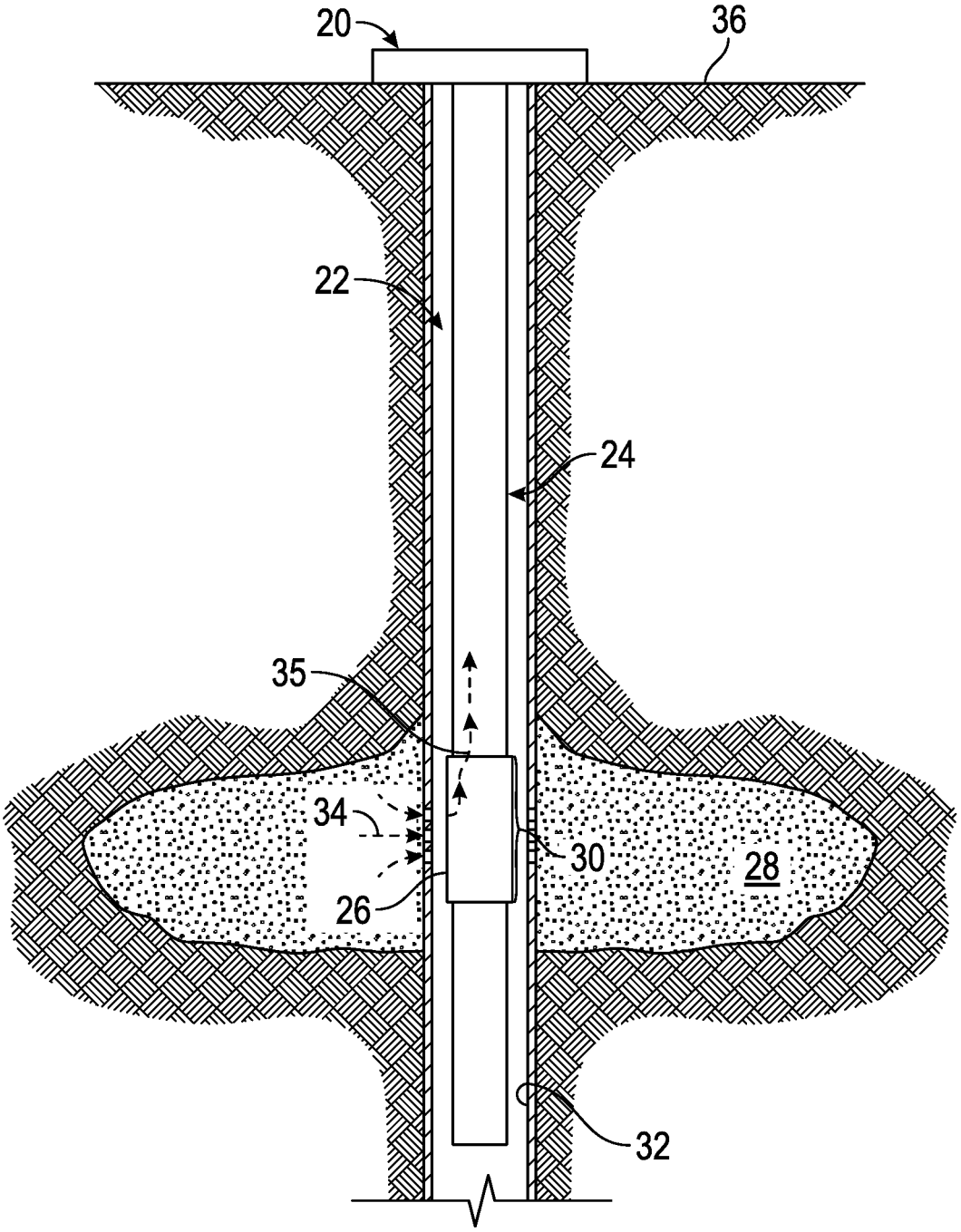
FIG. 1 is a schematic front elevation view of an embodiment of a well system having a packer assembly through which formation fluids may be collected, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for an expandable packer, such as an expandable packer assembly used as part of a downhole tool disposed in a wellbore. In certain embodiments, formation fluid samples are collected through an outer layer of the packer assembly and conveyed to a desired collection location. In addition, the packer assembly may include an expandable sealing element that enables the packer assembly to better support the formation in a produced zone at which formation fluids are collected. In certain embodiments, the packer assembly expands across an expansion zone, and formation fluids can be collected from the middle of the expansion zone, i.e. between axial ends of the outer sealing layer. The formation fluid collected is directed along flowlines, e.g. along flow tubes, having sufficient inner diameter to allow operations in a variety of environments. Formation fluid can be collected through one or more drains. For example, separate drains can be disposed along the length of the packer assembly to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

In certain embodiments, the packer assembly includes several components or layers, such as an outer skin and an inner packer disposed within the outer skin such that inflation of the inner packer causes the outer skin to expand. The packer assembly may also include a pair of mechanical fittings engaged with axial ends of the outer skin and a ring assembly disposed within at least one of the pair of mechanical fittings. The ring assembly may include one or more shear pins configured to shear upon application of a tensile force to the packer assembly. After shearing of the one or more shear pins, the outer skin, inner packer, and mechanical fittings may be able to move with respect to a mandrel of the packer assembly. For example, in certain situation, such as a loss of power, packer assemblies that do not include the ring assembly may be difficult to remove from the wellbore when the packer assembly is in an inflated state. This may be caused by the continued exertion of a suction force by drains disposed in the outer skin. However, the movement of the outer skin, inner packer, and mechanical fittings with respect to the mandrel upon application of the tensile force to the packer assembly in the disclosed embodiments may enable the packer assembly to be more easily removed from the wellbore. This may result from the cessation or reduction of the suction force by the drains. In certain embodiments, the packer assembly may include a transportation ring that is used to help prevent inadvertent actuation of the ring assembly, such as when the packer assembly is being transported or is outside of the wellbore.

Referring generally to FIG. 1, one embodiment of a well system 20 is illustrated as deployed in a wellbore 22. The well system 20 includes a conveyance 24 employed to deliver at least one packer assembly 26 downhole. In many applications, the packer assembly 26 is deployed by conveyance 24 in the form of a wireline, but conveyance 24 may have other forms, including tubing strings, for other applications. In the illustrated embodiment, the packer assembly 26 is used to collect formation fluids from a surrounding formation 28. The packer assembly 26 is selectively expanded in a radially outward direction to seal across an expansion zone 30 with a surrounding wellbore wall 32, such as a surrounding casing or open wellbore wall. When the packer assembly 26 is expanded to seal against wellbore wall 32, formation fluids can be flowed into the packer assembly 26, as indicated by arrows 34. The formation fluids are then directed to a flowline, as represented by arrows 35, and produced to a collection location, such as a location at a well site surface 36. As described in detail below, the packer assembly 26 may include a ring assembly that includes a shear pin configured to shear upon application of a tensile force to the packer assembly 26.

Figure 2:
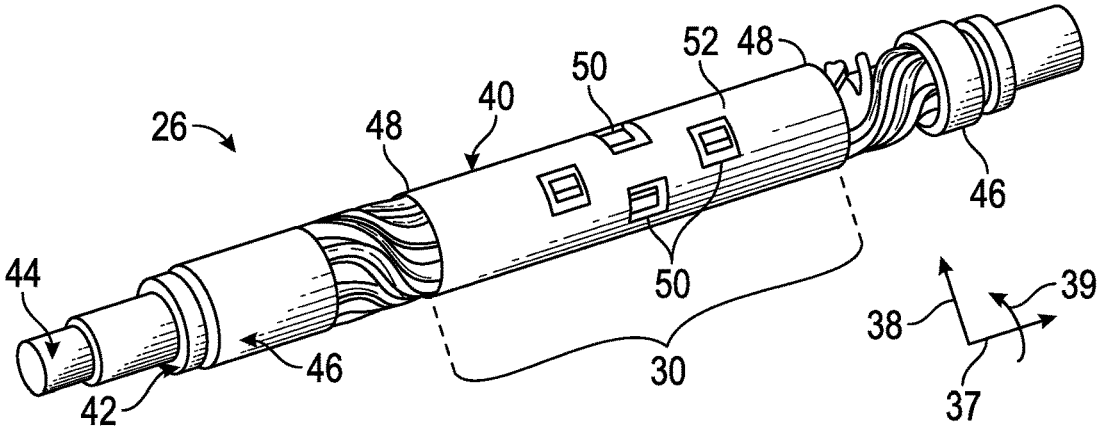
FIG. 2 is an orthogonal view of one example of the packer assembly illustrated in FIG. 1, according to an embodiment of the present disclosure.

Referring generally to FIG. 2, one embodiment of the packer assembly 26 is illustrated, which may have an axial axis or direction 37, a radial axis or direction 38, and a circumferential axis or direction 39. In this embodiment, packer assembly 26 includes an outer layer 40 (e.g., outer skin) that is expandable in the wellbore 22 to form a seal with surrounding wellbore wall 32 across expansion zone 30. The packer assembly 26 further includes an inner, inflatable bladder 42 disposed within an interior of outer layer 40. In one example, the inner bladder 42 (e.g., inner packer) is selectively expanded by fluid delivered via an inner mandrel 44. Furthermore, packer assembly 26 includes a pair of mechanical fittings 46 that are mounted around inner mandrel 44 and engaged with axial ends 48 of outer layer 40.

The outer layer 40 may include one or more windows or drains 50 through which formation fluid is collected when outer layer 40 is expanded against surrounding wellbore wall 32. Drains 50 may be embedded radially into a sealing element 52 of outer layer 40. By way of example, sealing element 52 may be cylindrical and formed of an elastomeric material selected for hydrocarbon based applications, such as nitrile rubber (NBR), hydrogenated nitrile butadiene rubber (HNBR), and fluorocarbon rubber (FKM).

Figure 3:
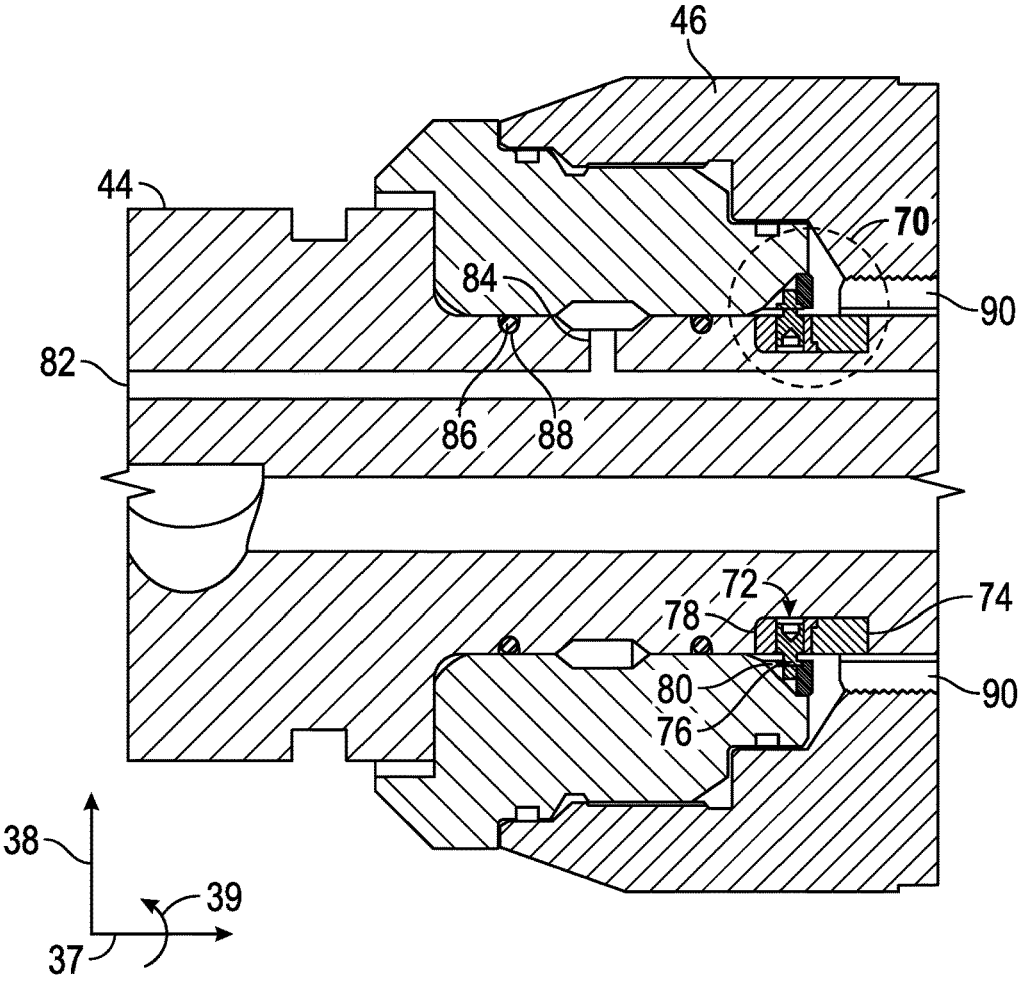
FIG. 3 is a cross-sectional view of a ring assembly of the packer assembly, according to an embodiment of the present disclosure.

FIG. 3 is a cross-sectional view of a ring assembly 70 of the packer assembly 26. As shown in FIG. 3, the ring assembly 70 is disposed in the mechanical fitting 46. In certain embodiments, the ring assembly 70 may include three components, namely a thrust ring 72, a ring 74, and a shear pin 76, which are shown in more detail in FIGS. 4-7. The thrust ring 72 includes an inner thrust ring 78 and an outer thrust ring 80 that are held together by the shear pin 76. When the shear pin 76 is sheared or separated, the inner thrust ring 78 remains with the mandrel 44 and the outer thrust ring 80 moves with the mechanical fitting 46. The ring 74 is disposed adjacent the inner thrust ring 78 and helps maintain the position of the thrust ring 72 in the packer assembly 26. In certain embodiments, the ring 74 may be omitted. A sampling flowline 82 may be disposed in the mandrel 44 and may be in fluid communication with one or more of the drains 50. Thus, the sampling flowline 82 may be used to transport formation fluids to other portions of the packer assembly 26 or other modules of the conveyance 24. As shown in FIG. 3, the sampling flowline 82 may include a sampling port 84 that may be uncovered after the shear pin 76 is sheared and the mechanical fitting 46 moves with respect to the mandrel 44 as described in detail below. An O-ring 86 may be disposed in a groove 88 surrounding the sampling port 84 to provide sealing between the inner mandrel 44 and the mechanical fitting 46. The sealing provided by the O-ring 86 is lost when the shear pin 76 is sheared. In addition, after the shear pin 76 is sheared, an inflation flowline 90 is exposed to the wellbore 22 and the inflation pressure for the inner packer 42 is released. Shearing of the shear pin 76 enables movement of the entire packer assembly (e.g., outer layer 40, inner packer 42, mechanical fittings 46, drains 50, and sealing element 52) along the inner mandrel 44. The thrust ring 72, ring 74, and shear pin 76 may be made from various metals or metal alloys.

Figure 4:
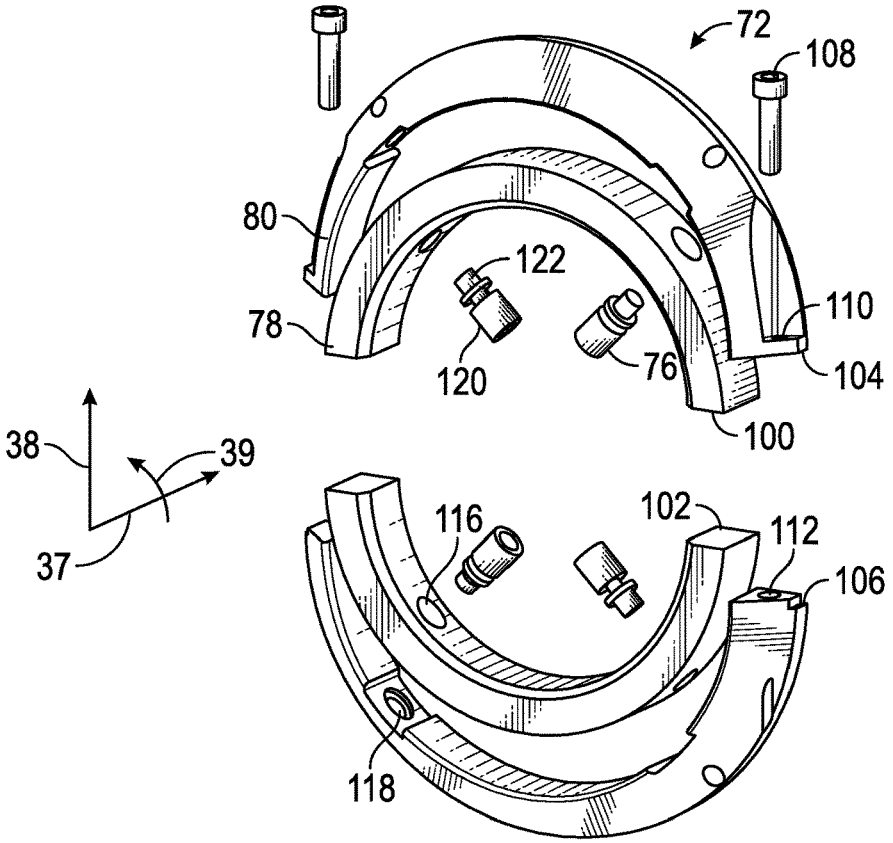
FIG. 4 is an exploded orthogonal view of a thrust ring of the ring assembly of the packer assembly, according to an embodiment of the present disclosure.

FIG. 4 is an exploded orthogonal view of the thrust ring 72 of the ring assembly 70 showing the inner and outer thrust rings 78 and 80, and four shear pins 76. In other embodiments, different numbers of shear pins 76 may be used, such as, but not limited to, one, two, three, five, six, seven, eight, or more shear pins. In the illustrated embodiment, the thrust ring 72 is configured as a split ring. Specifically, the inner thrust ring 78 may include an upper inner thrust split ring 100 and a lower inner thrust split ring 102. Similarly, the outer thrust ring 80 may include an upper outer thrust split ring 104 and a lower outer thrust split ring 106. As shown in FIG. 4, the inner and outer thrust rings 78 and 80 each include two split rings shaped as half rings or semicircles, which may facilitate assembly and maintenance of the thrust ring 72. The upper and lower outer thrust split rings 104 and 106 may be coupled to one another via split ring screws 108 inserted through upper split ring screw openings 110 and into lower split ring screw openings 112, which may have a threaded surface to engage threads of the split ring screws 108. In other embodiments, various techniques may be used to couple the upper and lower outer thrust split rings 104 and 106 to one another. Once the upper and lower outer thrust split rings 104 and 106 are coupled to one another, the upper and lower inner thrust split rings 100 and 102 are secured or kept against one another by the surrounding upper and lower outer thrust split rings 104 and 106.

In the illustrated embodiment of FIG. 4, the inner thrust ring 78 includes inner shear pin openings 116 and the outer thrust ring 80 includes outer shear pin openings 118 for the shear pins 76 to be inserted therethrough. Specifically, an inner shear pin portion 120 may be disposed in the inner shear pin opening 116 and an outer shear pin portion 122 may be disposed in the outer shear pin opening 118. After the shear pin 76 shears, the inner shear pin portion 120 remains in the inner shear pin opening 116 and the outer shear pin portion 122 remains in the outer shear pin opening 118, thereby enabling the inner thrust ring 78 to move axially 37 with respect to the outer thrust ring 80.

Figure 5:
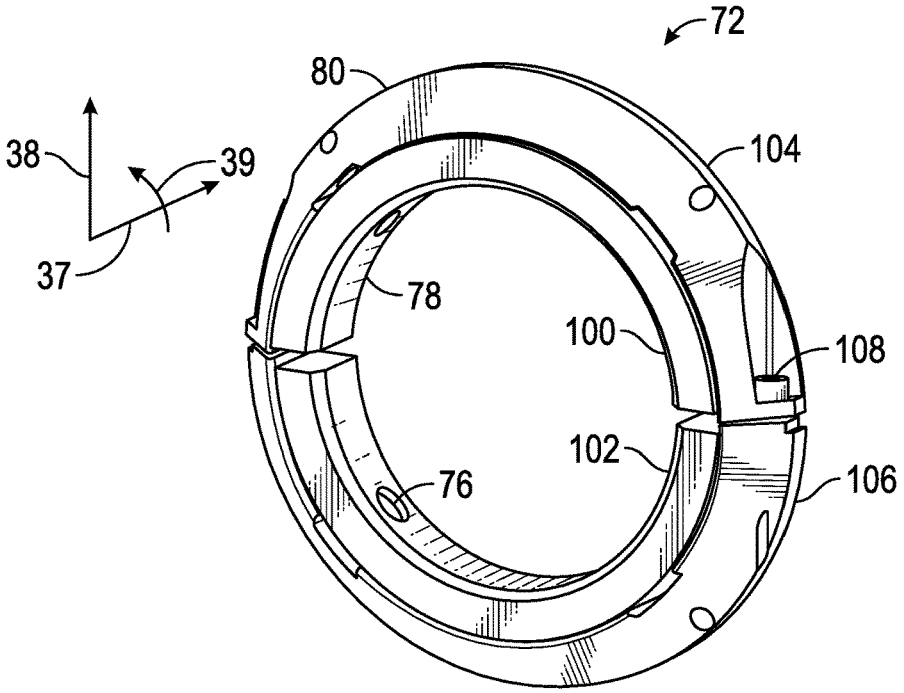
FIG. 5 is an orthogonal view of the thrust ring of the ring assembly of the packer assembly, according to an embodiment of the present disclosure.

FIG. 5 is an orthogonal view of a ring of the thrust ring 72 of the ring assembly 70 in an assembled configuration. As shown in FIG. 5, the split ring screws 108 are used to couple the upper and lower outer thrust split rings 104 and 106 to one another. The assembled thrust ring 72 may surround the inner mandrel 44 of the packer assembly 26 as shown in FIG. 3.

Figure 6:
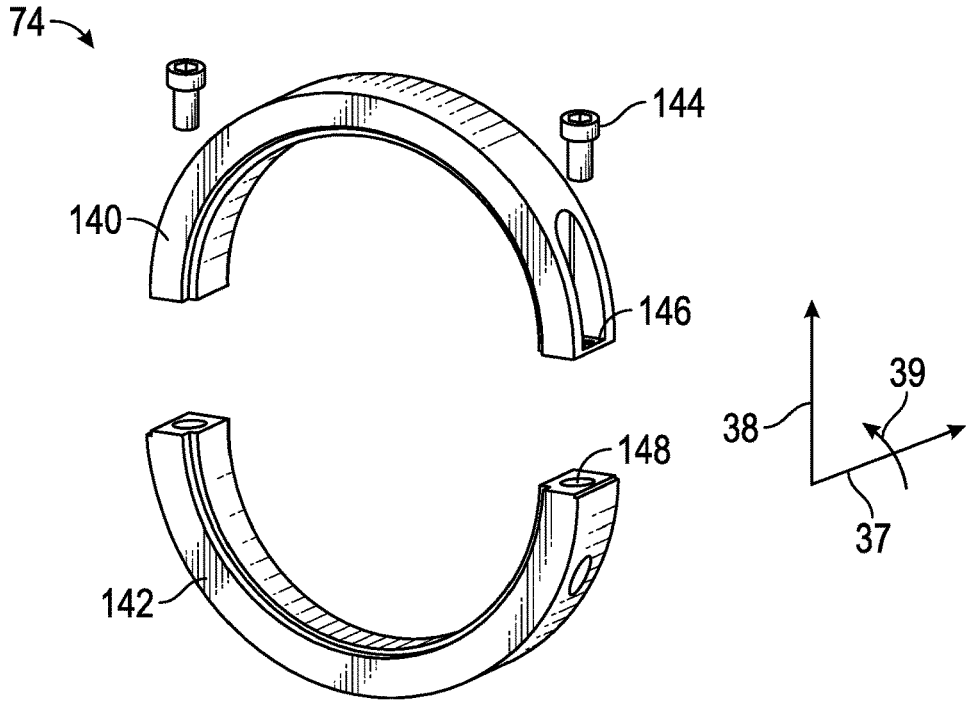
FIG. 6 is an exploded orthogonal view of a ring of the ring assembly of the packer assembly, according to an embodiment of the present disclosure.

FIG. 6 is an exploded orthogonal view of the ring 74 of the ring assembly 70. In the illustrated embodiment, the ring 74 is configured as a split ring. Specifically, the ring 74 may include an upper split ring 140 and a lower split ring 142, which may be shaped as half rings or semicircles to facilitate assembly and maintenance of the ring 74. The upper and lower split rings 140 and 142 may be coupled to one another via split ring screws 144 inserted through upper split ring screw openings 146 and into lower split ring screw openings 148, which may have a threaded surface to engage threads of the split ring screws 144. In other embodiments, various techniques may be used to couple the upper and lower split rings 140 and 142 to one another.

Figure 7:
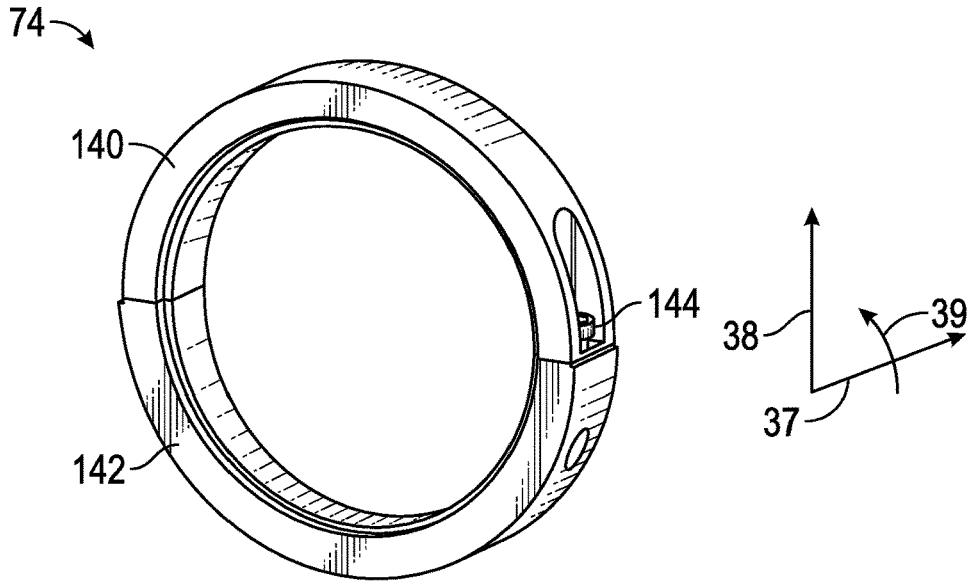
FIG. 7 is an orthogonal view of the ring of the ring assembly of the packer assembly, according to an embodiment of the present disclosure.

FIG. 7 is an orthogonal view of the ring 74 of the ring assembly 70 in an assembled configuration. As shown in FIG. 7, the split ring screws 144 are used to couple the upper and lower split rings 140 and 142 to one another. The assembled ring 74 may surround the inner mandrel 44 of the packer assembly 26 as shown in FIG. 3.

Figure 8:
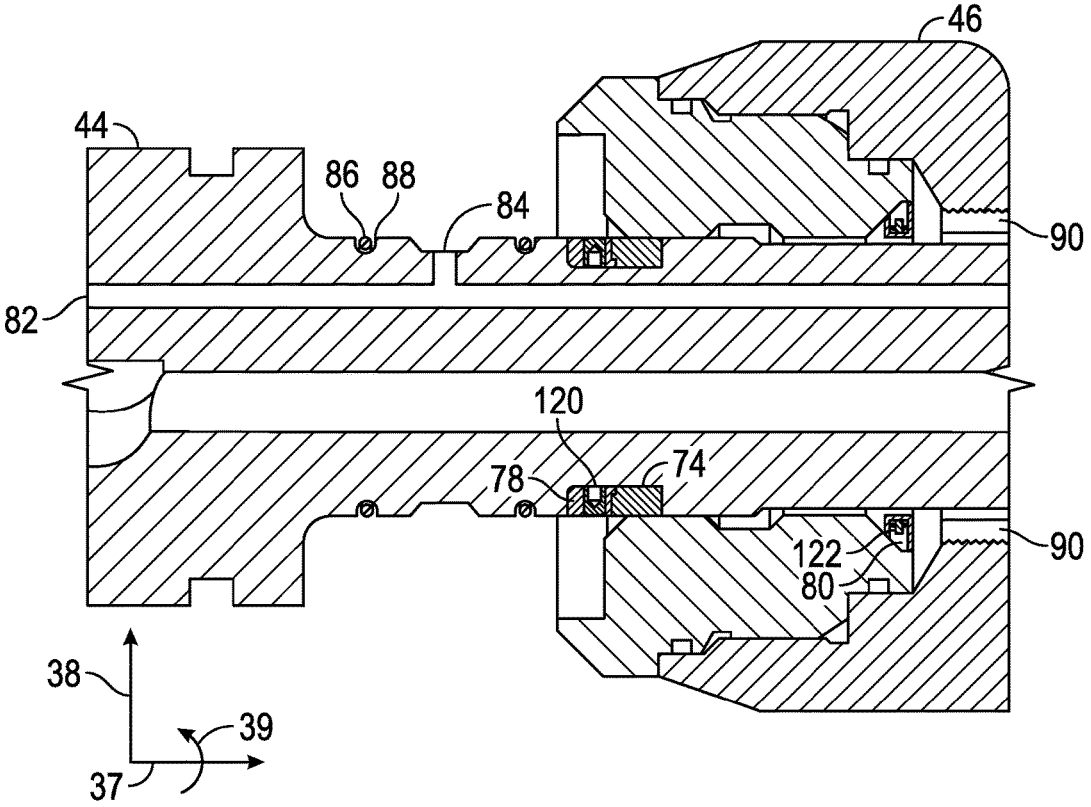
FIG. 8 is a cross-sectional view of the ring assembly of the packer assembly after application of a tensile force to the packer assembly, according to an embodiment of the present disclosure.

FIG. 8 is a cross-sectional view of the ring assembly 70 of the packer assembly 26 after application of a tensile force to the packer assembly 26. Specifically, the entire packer assembly (e.g., outer layer 40, inner packer 42, mechanical fittings 46, drains 50, and sealing element 52) has moved axially 37 with respect to the inner mandrel 44. As shown in FIG. 8, the shear pin 76 has sheared into the inner and outer shear pin portions 120 and 122. Thus, the inner thrust ring 78 has remained in the same position as shown in FIG. 3 (e.g., in the same position adjacent to the inner mandrel 44), but the outer thrust ring 80 has moved axially 37 together with the mechanical fitting 46. In other words, the inner and outer thrust rings 78 and 80 are no longer adjacent to one another. The ring 74 is still disposed adjacent to the inner thrust ring 78 (e.g., in the same position adjacent to the inner mandrel 44). As shown in FIG. 3, the sampling port 84 is uncovered and exposed to the wellbore 22 and wellbore pressure (e.g., sampling flowline 82 is equalized with hydrostatic pressure). Specifically, the sealing provided by the O-ring 86 disposed in the groove 88 is lost between the inner mandrel 44 and the mechanical fitting 46. As such, the pressure differential on the drains 50 is no longer maintained, thereby reducing or eliminating sticking forces maintaining the drains 50 and outer layer 40 against the wellbore wall 32 and facilitating removal of the packer assembly 26 from the wellbore 22 (e.g., pulling out of hole or POOH). In addition, the inflation pressure for the inner packer 42 is released when the inflation flowline 90 is exposed to the wellbore 22 after shearing of the shear pin 76. In other words, when the mechanical fitting 46 has moved so that there is no longer a seal around the sampling port 84 provided by the O-ring 86, the inflation flowline 90 is exposed to the wellbore 22 causing the inner packer 42 to deflate.

Figure 9:
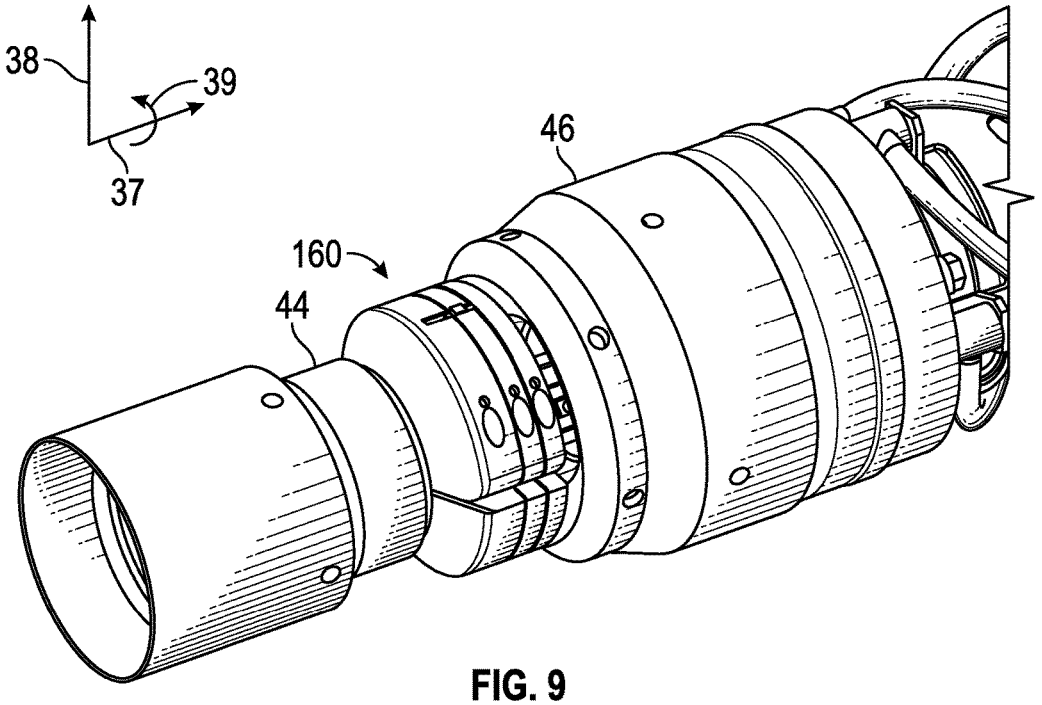
FIG. 9 is an orthogonal view of a transportation ring assembly of the packer assembly, according to an embodiment of the present disclosure.

FIG. 9 is an orthogonal view of a transportation ring assembly 160 of the packer assembly 26. In particular, the transportation ring assembly 160 may be used to block inadvertent operation of the ring assembly 70, such as during transportation or handling of the packer assembly 26 outside of the wellbore 22. As described in detail below with respect to FIGS. 10-14, the transportation ring assembly 160 may be easily mounted or disposed about the inner mandrel 44 without having to disassemble the packer assembly 26, well system 20, or conveyance 24.

Figure 10:
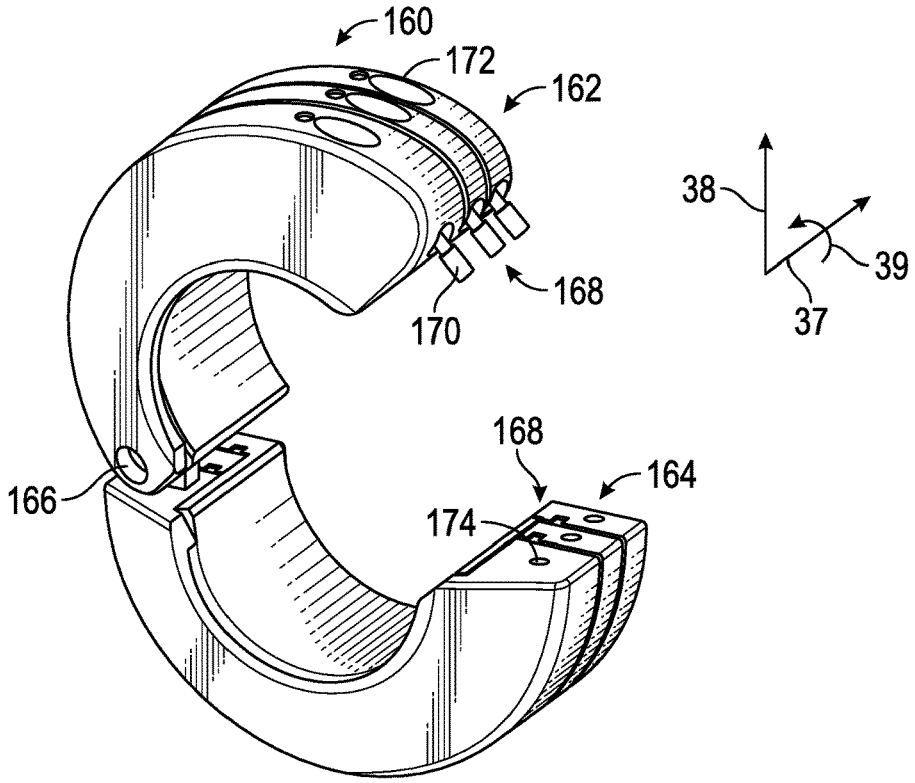
FIG. 10 is an orthogonal view of the transportation ring assembly in an open position, according to an embodiment of the present disclosure.

FIG. 10 is an orthogonal view of the transportation ring assembly 160 in an open position. As shown in FIG. 10, the transportation ring assembly 160 includes an upper transportation ring portion 162 and a lower transportation ring portion 164 coupled to one another via a transportation ring hinge 166. Use of such a configuration for the transportation ring assembly 160 enables the transportation ring assembly 160 to be slipped over the inner mandrel 44 and closed without disassembly of the packer assembly 26. The upper and lower transportation ring portions 162 and 164 may be coupled to one another via a locking mechanism 168. For example, the locking mechanism may include transportation screws 170 inserted through upper transportation ring openings 172 and into lower transportation ring screw openings 174, which may have a threaded surface to engage threads of the transportation screws 170. In certain embodiments described in more detail below, the transportation ring assembly 160 may include two or more rings coupled to one another and each of the rings may include a separate transportation screw 170, upper transportation ring opening 172, and lower transportation ring screw opening 174.

Figure 11:
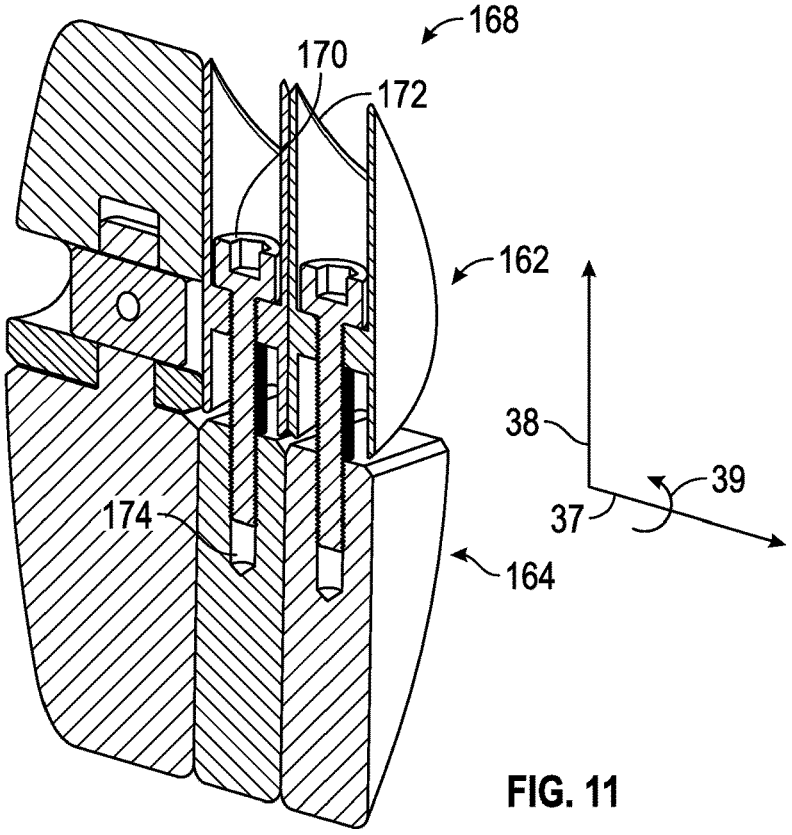
FIG. 11 is a cross-sectional view of a locking mechanism of the transportation ring assembly, according to an embodiment of the present disclosure.

FIG. 11 is a cross-sectional view of the locking mechanism 168 with the transportation ring assembly 160 in a closed position. As shown in FIG. 11, the transportation screws 170 are inserted through the upper transportation ring openings 172 and engaged with the lower transportation ring screw openings 174. By tightening the transportation screws 170, the transportation ring assembly 160 may be maintained in the closed position about the inner mandrel 44. In other embodiments, various techniques may be used to couple the upper and lower transportation ring portions 162 and 164 to one another.

Figure 12:
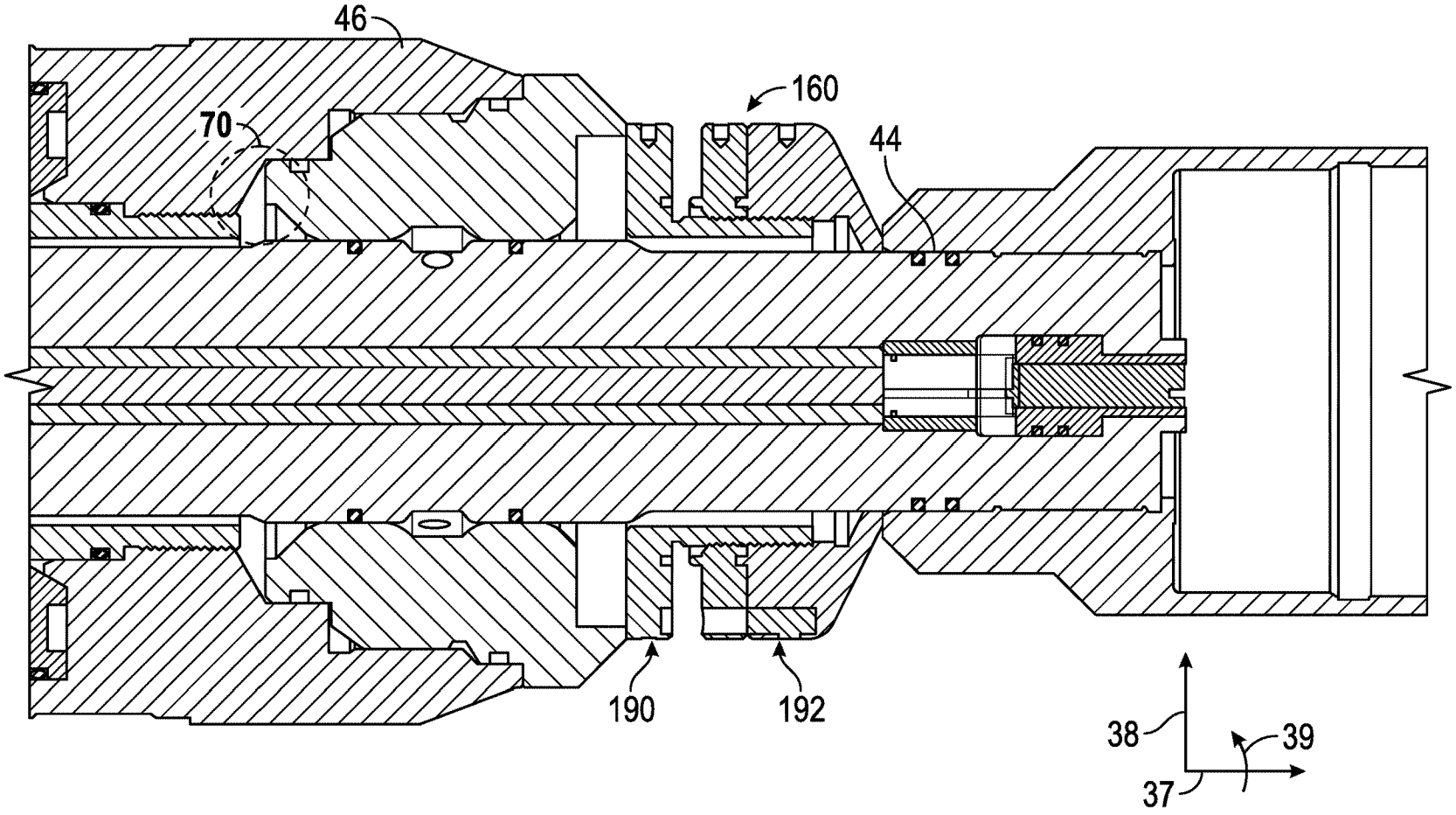
FIG. 12 is a cross-sectional view of the transportation ring assembly, according to an embodiment of the present disclosure.

FIG. 12 is a cross-sectional view of the transportation ring assembly 160 mounted about the inner mandrel 44 of the packer assembly 26. As shown in FIG. 12, the transportation ring assembly 160 blocks the mechanical fitting 46 from moving with respect to the inner mandrel 44 by taking up the entire space between the mechanical fitting 46 and the inner mandrel 44. In other words, the transportation ring assembly 160 blocks the ring assembly 70 from operating or being deployed (e.g., shearing of the shear pins 76). Thus, the transportation ring assembly 160 may be useful to block inadvertent operation of the ring assembly 70, such as during transportation or handling of the packer assembly 26 outside of the wellbore 22. In addition, the transportation ring assembly 160 may include a first threaded ring 190 and a second threaded ring 192 configured to engage with the first threaded ring 190 such that rotation of the second threaded ring 192 causes the transportation ring assembly 160 to expand from an unexpanded state to an expanded state as shown in FIG. 12. Thus, the transportation ring assembly 160 may be installed in the unexpanded state and then the second threaded ring 192 rotated such that the transportation ring assembly 160 expands to the expanded state taking up the entire space between the mechanical fitting 46 and the inner mandrel 44, thereby blocking movement of the mechanical fitting 46. In addition, the use of the first and second threaded rings 190 and 192 may enable the same transportation ring assembly 160 to be used for various packer assemblies 26 with different distances or lengths between the mechanical fitting 46 and the inner mandrel 44, thereby improving the flexibility of the transportation ring assembly 160.

Figure 13:
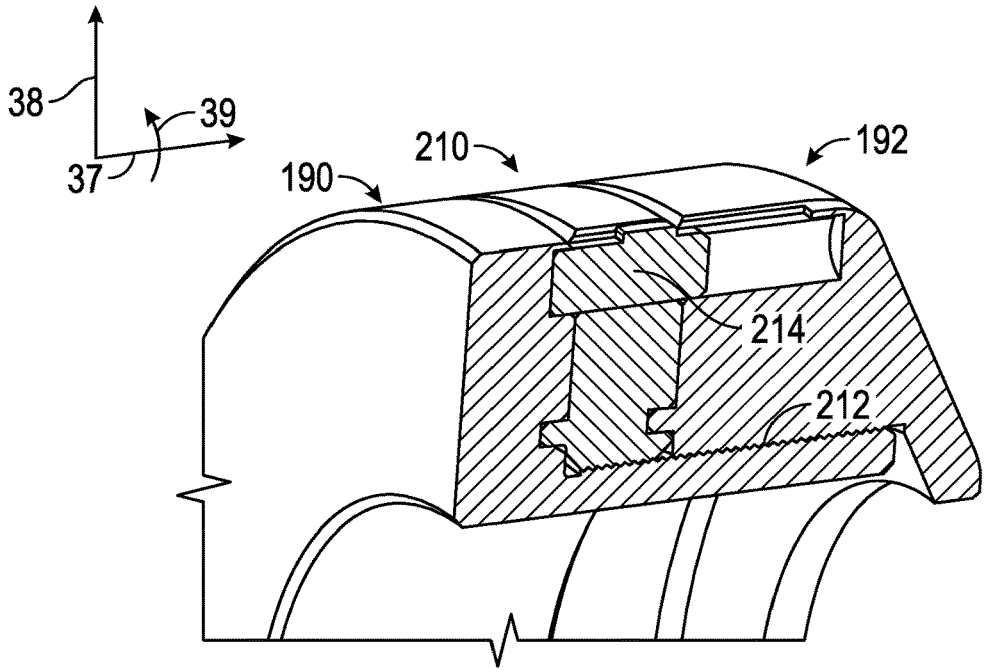
FIG. 13 is a cross-sectional view of a captive sliding latch of the transportation ring assembly, according to an embodiment of the present disclosure.

FIG. 13 is a cross-sectional view of a captive sliding latch 210 of the transportation ring assembly 160. Specifically, the captive sliding latch 210 may be used to couple the first and second threaded rings 190 and 192 to one another. The transportation ring assembly 160 is shown in the unexpanded state in FIG. 13. Thus, the first and second threaded rings 190 and 192 are adjacent to one another. Threads 212 disposed along the first and second threaded rings 190 and 192 enable the first and second threaded rings 190 and 192 to be rotated with respect to one another and move apart from one another. A portion 214 of the captive sliding latch 210 keeps the first and second threaded rings 190 and 192 coupled to one another while the transportation ring assembly 160 is in the unexpanded state shown in FIG. 13.

Figure 14:
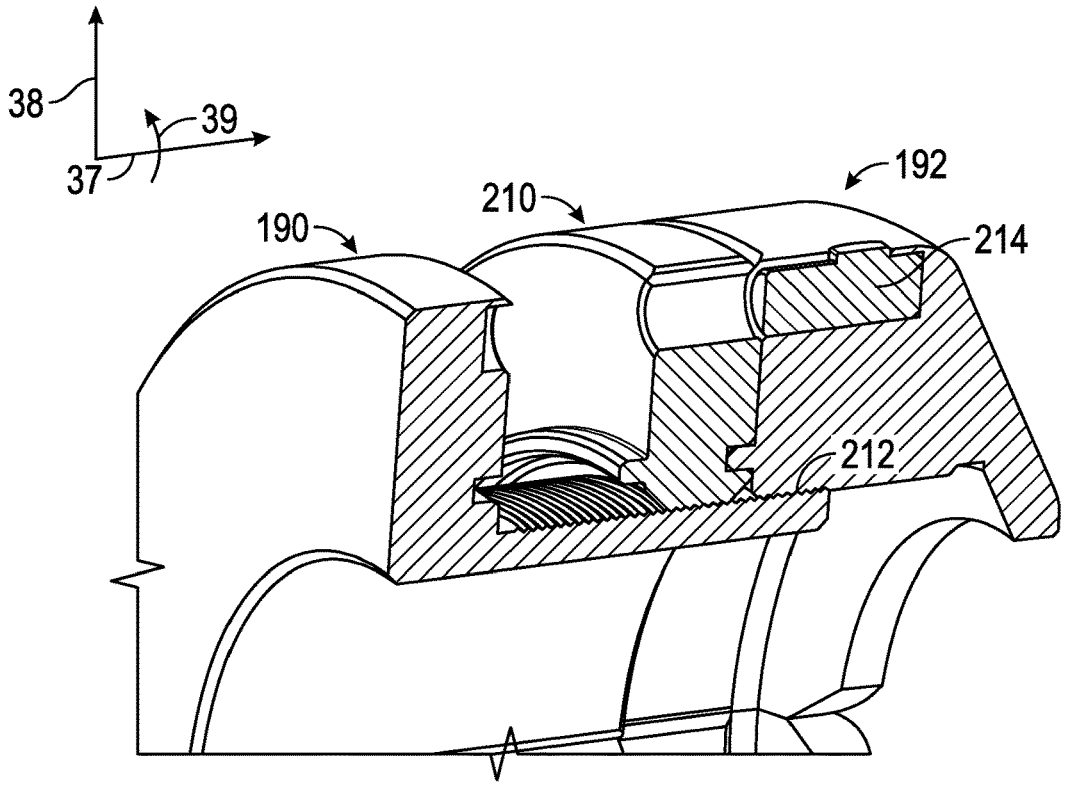
FIG. 14 is a cross-sectional view of the captive sliding latch of the transportation ring assembly, according to an embodiment of the present disclosure.

FIG. 14 is a cross-sectional view of the captive sliding latch 210 of the transportation ring assembly 160 in the expanded state. Specifically, the first and second threaded rings 190 and 192 have moved apart from one another and the portion 214 of the captive sliding latch 210 keeps rings of the second threaded ring 192 together.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole packer assembly, comprising:

an outer skin;

an inner packer disposed within the outer skin such that inflation of the inner packer is configured to expand the outer skin;

a pair of mechanical fittings engaged with axial ends of the outer skin; and a ring assembly disposed within at least one of the pair of mechanical fittings, wherein the ring assembly comprises a shear pin configured to shear upon application of a tensile force to the downhole packer assembly, wherein at least one of the pair of mechanical fittings is configured to cover a sampling port of the downhole packer assembly in a first axial position, wherein the at least one of the pair of mechanical fittings is configured to expose the sampling port of the downhole packer assembly in a second axial position after shearing of the shear pin, and wherein the inner packer is configured to deflate in response to the sampling port being exposed.

2. The downhole packer assembly of claim 1, wherein the ring assembly comprises a split ring having a first split ring portion and a second split ring portion.

3. The downhole packer assembly of claim 1, wherein the ring assembly comprises a plurality of shear pins disposed circumferentially about the ring assembly.

4. The downhole packer assembly of claim 1, wherein the shearing of the shear pin is configured to enable unsticking of the downhole packer assembly from a wellbore.

5. The downhole packer assembly of claim 1, comprising a transportation ring assembly disposed adjacent to at least one of the pair of mechanical fittings, wherein the transportation ring assembly is configured to block axial movement of the pair of mechanical fittings.

6. The downhole packer assembly of claim 5, wherein the transportation ring assembly comprises a split transportation ring having a first split transportation ring portion and a second split transportation ring portion.

7. The downhole packer assembly of claim 6, wherein the first and second split transportation ring portions are coupled to one another via a hinge and a locking mechanism.

8. The downhole packer assembly of claim 7, wherein the locking mechanism comprises a screw disposed in the first split transportation ring portion and a threaded hole disposed in the second split transportation ring portion and configured to receive the screw.

9. The downhole packer assembly of claim 5, wherein the transportation ring assembly comprises a first threaded ring and a second threaded ring configured to engage with the first threaded ring such that rotation of the second threaded ring causes the transportation ring assembly to expand from an unexpanded state to an expanded state.

10. The downhole packer assembly of claim 9, wherein axial movement of the pair of mechanical fittings is blocked when the transportation ring assembly is in the expanded state.

11. The downhole packer assembly of claim 9, wherein a captive sliding latch is configured to couple the first and second threaded rings to one another.

12. The downhole packer assembly of claim 1, wherein the downhole packer assembly is configured for conveyance within a wellbore by at least one of a wireline or a drillstring.

13. A method, comprising:

providing a packer assembly having an inner packer disposed within an outer skin, a pair of mechanical fittings engaged with axial ends of the outer skin, and a ring assembly disposed within at least one of the pair of mechanical fittings, wherein the ring assembly comprises a shear pin;

positioning the packer assembly in a wellbore;

inflating the inner packer until the outer skin seals against a wall of the wellbore;

applying a tensile force to the packer assembly;

shearing the shear pin; and axially moving at least one of the pair of mechanical fittings from a first axial position to a second axial position in response to shearing the shear pin, wherein a sampling port of the packer assembly is configured to be covered when the at least one of the pair of mechanical fittings is in the first axial position, wherein the sampling port of the packer assembly is configured to be exposed when the at least one of the pair of mechanical fittings is in the second axial position, and wherein the inner packer is deflated in response to the sampling port being exposed.

14. The method of claim 13, comprising unsticking the packer assembly from the wellbore after shearing the shear pin.

15. The method of claim 13, comprising:

providing the packer assembly with a transportation ring assembly disposed adjacent to at least one of the pair of mechanical fittings, wherein the transportation ring assembly is configured to block axial movement of the pair of mechanical fittings; and removing the transportation ring assembly from the packer assembly prior to positioning the packer assembly in the wellbore.

* * * * *